United States Patent [19]

Wada et al.

[11] 4,209,559

[45] Jun. 24, 1980

[54] LINEAR CRYSTALLINE TEREPHTHALATE POLYESTER YARN AND TEXTILE GOODS MADE THEREFROM

[75] Inventors: Osamu Wada; Yoshiyuki Sasaki, both of Takatsuki; Shiro Kumakawa, Kyoto; Akio Kimura, Ashiya; Toshimasa Shimizu, Matsuyama; Hiroyuki Nagai, Ehime; Shunichi Takeda, Kyoto; Takumi Shimazu, Matsuyama, all of Japan

[73] Assignee: Teijin Limited, Osaka, Japan

[21] Appl. No.: 23,918

[22] Filed: Mar. 26, 1979

[30] Foreign Application Priority Data

| | | | |
|---|---|---|---|
| Mar. 27, 1978 | [JP] | Japan | 53-34042 |
| Apr. 7, 1978 | [JP] | Japan | 53-40202 |
| Apr. 7, 1978 | [JP] | Japan | 53-40203 |
| May 8, 1978 | [JP] | Japan | 53-53785 |
| May 22, 1978 | [JP] | Japan | 53-59883 |
| Jul. 26, 1978 | [JP] | Japan | 53-90374 |

[51] Int. Cl.[2] ..... D02G 3/02; B32B 3/00; B32B 7/02; B32B 27/36

[52] U.S. Cl. ..... 428/91; 428/224; 428/280; 428/296; 428/359; 428/364; 428/480; 428/903

[58] Field of Search ..... 428/97, 91, 224, 280, 428/296, 297, 359, 364, 373, 480, 903

[56] References Cited

U.S. PATENT DOCUMENTS

| | | | |
|---|---|---|---|
| 2,783,609 | 3/1957 | Breen | 264/168 |
| 2,985,995 | 5/1961 | Bunting, Jr. et al. | 264/103 |
| 3,199,281 | 8/1965 | Maerov et al. | 428/364 |
| 3,546,063 | 12/1970 | Breen | 428/364 |
| 4,118,531 | 10/1978 | Hauser | 428/364 |
| 4,146,663 | 3/1979 | Ikeda et al. | 428/903 |
| 4,147,574 | 4/1979 | Setsuie et al. | 428/903 |
| 4,157,419 | 6/1979 | Mirhej | 428/364 |
| 4,159,617 | 7/1979 | Allan | 428/364 |

*Primary Examiner*—William J. Van Balen

*Attorney, Agent, or Firm*—Sughrue, Rothwell, Mion, Zinn and Macpeak

[57] ABSTRACT

Novel polyester filamentary yarn is provided having (a) a fineness of 0.9 denier per filament or less, (b) an amorphous orientation in the range of 30% to 70% and (c) a negative $\epsilon_{0.2}$ where said $\epsilon_{0.2}$ is a structural integrity parameter. The yarn possesses ameliorated properties regarding a heat-setting property, a raising property, a dimensional stability and a twist resistance. The yarn finds its wide range of usage, for example, silky fabrics with an excellent fullness, pliability and liveliness, raised fabrics with thermally stabilized fluffs protruding straight-forwardly and an extremely soft hand, and uniformly creped fabrics with an improved surface contour are obtained therefrom.

11 Claims, No Drawings

LINEAR CRYSTALLINE TEREPHTHALATE POLYESTER YARN AND TEXTILE GOODS MADE THEREFROM

BACKGROUND OF THE INVENTION

This invention relates to a crystalline polyester multi-filamentary yarn comprising extra-fine filaments, which possesses ameliorated properties regarding a heat-setting property, a raising or napping property, a dimensional stability, a twist resistance which enables one to employ a higher twist coefficient in the false-twist crimping. This invention also relates to a commingled yarn and a cloth, both of which comprising said crystalline polyester multi-filamentary yarn.

So called extra-fine filaments of 0.9 denier per filament or less have achieved a wide commercial acceptability since said filaments, owing to their preferable hand, are useful for natural skin-like fabrics especially suede-like goods when cloths comprising said filaments are raised.

Heretofore various methods have been proposed for the production of such filamentary yarns or fibres. There are (a) to dissolve a sea component out of sea-island type conjugated yarns, (b) to split side-by-side type conjugated yarns, (c) to cause extruded filaments flow-drawing for the purpose of obtaining leant filaments followed by neck-drawing, (d) to make leant filaments by use of a conventional spinning and drawing process, and (e) to obtain oriented extra-fine filaments by use of a high speed spinning step of more than 3000 meters/minute.

Of those processes mentioned above, (a) and (b) are considerably expensive because they requires not only a special and complicated spinning device but also two or more different polymers and an additional tedious step to dissolve out the sea component and to split resulting fibrils consisting of island components. In the processes of (c) and (d), it is rather difficult to produce desired filaments of 0.9 denier per filament or less due to frequent and increasing occurrence of yarn breakage as the filaments decreases in fineness during the drawing operation and the denier variation is unavoidably enhanced even if the fine filaments may be obtained occasionally.

On the other hand, the high speed spinning process according to (e) bears an advantage to produce fine filaments in simplicity and further without causing particular problems.

The inventors have found, in the course of research for preparing extra-fine filaments by mean of the high speed spinning process for the purpose of making the most use of said process, that a crystalline polyester multifilamentary yarn can be prepared which presents various peculiar properties never conceived in conventional yarns heretofore produced. Further the said yarn finds its use as for silky or velours-like goods by using the same in the form of a commingled yarn with other filaments, and also its use as for raised, crepe (crepon georgette inclusive) and anti airpermeative goods having an improved hand as well as appearance by subjecting a cloth comprising said crystalline filamentary yarn to a proper finishing operation.

BRIEF SUMMARY OF THE INVENTION

According to the present invention, there are provided:

(a) a crystalline polyester yarn comprising a bundle of extra-fine filaments, each of individual constituents having a fineness of 0.9 denier or less and an amorphous orientation (fa) in the range of 30% to 70% and, a structural integrity parameter ($\epsilon_{0.2}$) of said yarn being negative, (b) a commingled yarn comprising at least two component yarns in which said crystalline polyester yarn (a) exists as one of the components, and (c) cloths comprising said crystalline polyester yarn (a), in which the peculiar properties thereof has been preferably utilized.

It is the primary object of the present invention to provide a crystalline polyester multi-filamentary yarn composed of a bundle of extra-fine filaments which bears ameliorated properties regarding a heat-setting property, a raising or napping property, a dimensional stability and a twist resistance which enables one to employ a higher twist coefficient in the false twist crimping.

The second object of the present invention is to provide a commingled yarn similar to natural silk in terms of hand, touch, function and other properties.

The third object of the present invention is to provide a velours-like textured yarn extremely similar to natural ones, using a synthetic yarn as a starting material.

The fourth object of the present invention is to provide a polyester cloth having an enhanced resistivity to air permeation in addition to extremely soft hand.

The fifth object of the present invention is to provide a raised polyester cloth in which each of fluffs or free ends protrudes straight-forwardly without crimps, said cloth presenting a smooth touch and a superior appearance as well as lustre.

The sixth object of the present invention is to provide a hard-twist crepe fabric having silk-like supple touch and draperability.

Further objects and advantages of the present invention will be apparent from the following description and the appended claims.

DETAILED DESCRIPTION

In the invention, by "polyester" is meant a linear polyester composed of ethylene terephthalate units as main recurring structural units, more concretely polyethylene terephthalate. Of course, third components (up to about 15 mol percent based on terephthalic acid or ethylene glycol) may be copolymerized or blended in the polyester so long as the essential properties of polyethylene terephthalate are not modified. Although the polymerization degree of such polyester may be optionally selected as occasion demands, intrinsic viscosity [$\eta$] of about 0.40 to 0.70 measured by use of a solution of 1.0 gram polymer in 100 cc. of orthochlorophenol is advantageously recommended in case of polyethylene terephtharate.

As one of examples for preparation of the crystalline polyester yarn according to the invention, such process may be cited comprising steps of:

(i) extruding a melted polymer through orifices and forwarding the spun filaments at a draft ratio of 200 to 700 (preferably 300–700);

(ii) heat treating the spun filaments at a temperature of 100° C. or more and below a melting point of the polymer (preferably 140° C.–240° C.) for a time of about 0.01 second to 0.05 second while said filaments being kept under a substantially zero overfed state or a stretched state of at most 20%; and (iii) withdrawing thus heat-set filaments having a fineness of 0.9 denier per filament or less (preferably 0.6 denier or less) at a winding speed of 3000 meters/minute to about 5000 meters/minute (preferably 3300 meters/-minute—4500 meters/minute).

In the above, each diameter of the orifices of a spinneret is preferably in the range of 0.1 mm to 0.4 mm (more preferably 0.1 mm–0.2 mm), and a spinning (melt) temperature of 290° C. to 305° C. is preferably employed wherein the extruded filaments through the spinneret is, preferably quenched to form a solidified yarn by blowing a quenching air thereupon from the lateral direction. Further, the above mentioned heat treatment under a substantially zero overfed state or a stretched state of at most 20% stretch ratio may be carried out, for example, by turning the filamentary yarn around a heated roll several times which is located downstream of an usual first godet roll or the same effect can be achieved without said heated roll, instead, by direct heating of said godet roll around which the filamentary yarn, in turn, may be turned several times. In case that a plurality of godet rolls are provided with, some of them may be heated. Generally, the traverse motion of a winding device causes remarkable winding tension variation of a yarn as it is heated to a higher temperature. To avoid such tension variation it is recommended to cool the yarn positively, which leaves the final heated godet roll. Alternatively, the final godet roll may be maintained at a ambient temperature while the other godet rolls are heated to a desired temperature. As for a stretch ratio, it may be adjusted by a difference of the peripheral speed between a first godet roll for receiving the extruded filaments and the heated godet roll located downstream of the first godet roll or a difference among a plurality of godet rolls. When a tapered roll or a stepped roll is used for a heat-stretching a yarn in such manner that the traveling filamentary yarn is turned around said roll several times, more preferable treating effect can be obtained since said process becomes stabilized in an improved processability.

As mentioned hereinbefore, the crystalline polyester multi-filamentary yarn according to the present invention has a fineness of 0.9 denier per filament or less, preferably 0.6 denier per filament or less. In case these yarns are applied to the preparation of a silky woven or knitted fabric, the yarns should have a denier per filament as fine as silk, namely 0.9 denier or less. In constrast, it is preferable to employ the yarns of 0.6 denier per filament or less for the preparation of raised goods.

Further, an individual filaments constituting the yarn according to the present invention has an amorphous orientation (fa) in the range of 30% to 70% and said yarn itself has negative $\epsilon_{0.2}$ (a structural integrity parameter) and preferably, said value lies in the following range, namely, $0>\epsilon_{0.2}\geqq-0.0025$. When the above mentioned properties in combination with a special range of a denier per filament satisfied in a crystalline polyester multi-filamentary yarn, said yarn shows ameliorated functions in a heat-setting property, a raising property, a dimensional stability and a twist resistance which enables one to employ a higher twist coefficient in the false-twist crimping.

Also, the yarn according to the present invention shows a superior dimensional stability due to being crystalline. This dimensional stability can be greatly enhanced when the yarn is imparted a boil-off shrinkage of no more than 7.5%, a cristallinity of no less than 30% calculated from the density thereof hereinafter mentioned and a density of 1.335 grams/cm$^3$ for an amorphous phase.

As clear from the above, it may be stated that the multi-filamentary yarn according to the invention bears a merit of a extremely diminished shrinkage during a thermal treatment due to the following constituents:

(i) the filaments are crystalline, (ii) they have a proper range of an amorphous orientation, and (iii) they shows a lower thermal shrinkage stress since a coagulation energy in an amorphous phase of the filaments is low and the density of the amorphous phase is high.

The crystalline multi-filamentary yarn of the invention may be imparted a considerably slight cohesive or unitary function for the purpose of securing the running and handling property of the yarn. This cohesive effect can be obtained by subjecting the heat-stretched filaments to a so called interlacing treatment prior to winding said filaments.

However, it has been confirmed that certain undesirable problems such as fuzzing or looping of the individual filaments arise when the yarn is treated by conventional interlacing methods. The reason for the above is that the yarn of extra-fine denier per filament is not able to withstand a heavy turbulent action by fluid medium in the interlace to result in broken filaments. Therefore, the interlace treatment should be carried out under milder conditions as compared with the conventional ones to impart the yarn a coherency factor of 5/meter to 40/meter (preferably 10–30/meter) measured by a slight pin-count testing hereinafter defined. A method for preparation of such slightly cohesive yarn is disclosed in detail in the specification of Japanese Laid-open No. 88612/1977.

As one of the usage embodiments of the yarn according to the present invention, a commingled yarn comes first comprising at least two different filamentary yarn, in which:

[I] a linear crystalline terephthalate polyester yarn comprising a bundle of extra-fine filaments, each of individual constituents has a fineness of 0.9 denier or less and an amorphous orientation (fa) in the range of 30% to 70% and, a structural integrity parameter ($\epsilon_{0.2}$) of said yarn is negative, and

[II] polyester filamentary yarn having a fineness of 1 to 3 denier per filament, a structural integrity parameter of which is at least 0.005 lesser than that of yarn [I] and, said yarn [I] and [II] being intermingled each other in such ratio that yarn [I] occupies 20–80% and yarn [II] 80–20% by weight based on the commingled yarn, respectively.

Further explanation will be made with regard to the function of each component yarn.

Upon heat-relaxation of the commingled yarn, yarn [II] easily contracts compared to yarn [I] whereby a bulky yarn is formed by differential shrinkage of component filaments in which the former tends to occupy a relatively core portion of the bulky yarn, the latter tends to lie around the former in a loopy configuration. In this case, the inventors remarked a structual integrity parameter ($\epsilon_{0.2}$) of the easily contractable component [Yarn (II)] which constitutes a part of the commingled yarn and it has been confirmed that a fabric made from such commingled yarn can be imparted liveliness when said commingled yarn comprises a yarn having 1 denier to 3 denier per filament and $\epsilon_{0.2}$ of less than $-0.025$ as a contracting component. In contrast, a filamentary yarn [Yarn (I)] having 0.9 denier per filament or less and a value for $\epsilon_{0.2}$ more than that of the contracting component gives preferable surface touch or tactility and fullness effect. In other words, the filamentary yarn [II] with $\epsilon_{0.2}$ less than $-0.025$ makes itself sufficient shrinkage even if being put under restraint in the weave structure while the filamentary yarn [II] with $\epsilon_{0.2}$ of less than zero and not less than $-0.025$ ($0 > \epsilon_{0.2} \geqq -0.025$) constitutes a float or loop component since the heat shrinkage stress of the latter is relatively lower than that of the former. On the other hand when a yarn with zero or positive $\epsilon_{0.2}$ is employed in combination with yarn [II], the bulky fabric made from the above presents only a useless sponge-like touch since the yarn with zero or positive $\epsilon_{0.2}$ is apt to extend easily even under a slight load due to its extremely low shrinkage stress.

As the contracting component, such filamentary yarn is typically used, that can be obtained by heat-stretching at a stretch ratio of more than 50% a partially oriented filaments spun at a spinning speed of more than 3000 meters/minute. Important is that the above contracting component should have a filament (mono-filament) denier larger than that of float component and generally, it may ranges from 1 denier to 3 deniers thereby desirable liveliness of the fabric is effected. Between the components, the difference of $\epsilon_{0.2}$ in 0.05 is sufficient to obtain a desired differential shrinkage and they are subjected to a commingling treatment optionally in different cross section, dyeability and lustre. As for the amount of each component, it is necessary that yarn [I] should occupy 20%–80% by weight based on the commingled yarn and accordingly yarn [II] occupies 80%–20% by weight. Outside said range, softness, fullness and liveliness aimed at are not satisfied concurrently.

Commingling of both component yarns may be effected by any process known in the art such as to gather and double both components, each of them being separated previously by means of a static electricity or a pneumatic medium or to commingle and interlace both components in doubled state by introducing them to a turbulent fluid zone. However, in view of the commercial productivity as well as the handling and running property of the processed yarn, the most preferable is an interlace means. This technology, as already described, in the specification of U.S. Pat. No. 2,985,995, employs an overfeed ratio of substantially zero in terms of "net overfeed" under which both components in double state is introduced into a turbulent zone.

The commingled yarn thus obtained has, preferably a total denier of at least 30 deniers, otherwise the thickness of the yarn will be insufficient for a constituent of ordinary fabrics and also the number of filaments required for the commingled yarn will be shortened.

In addition to both components [I] and [II], other filamentary yarn with positive $\epsilon_{0.2}$ and a fineness 3 denier to 5 denier per filament may be added to. By the use of such third component, the three-face structure is formed in the heat relaxed fabric made from said three components system, namely the first (surface) face serves as an improvement in fullness, softness and tactility. While, the gradient effect as for liveliness will be developed toward the inner portion of the fabric, thus resulting really in silk-like product.

Such commingled yarn is subsequently subjected to a weaving (or knitting) process without heat-relaxing the same, wherein the yarn may be used in a substantially non-twisted or twisted (post twisted) form. Further these yarns can be used as the warps and/or the wefts, each of which may be optionally applied to in a non-twisted or a twisted form.

Then, the woven fabric when dipped and relaxed in hot water in the form of a scouring or dyeing bath developes silk-like fullness and surface touch due to differential shrinkage stress among the filaments. Such relaxation treatment can be combined with an alkaline treatment which promotes a reduction in the weight of the fabric. This treatment is advantageous for obtaining silk-like draperbility and liveliness as a contact pressing power between the warp and the weft decreases due to increase in the interfilamentary space and generally, applied to a pre-set grey fabric increased in crimp of the yarns which has been previously relaxed to undergo a sufficient shrinkage.

In turn, it can be noted as an another advantageous property of the yarn according to the invention that it is much suited for raised goods owing to the superior raising or napping property thereof in a yarn state as well as a cloth state. Particularly, a snap back power, e.g. a restoring power of the broken portion of a free end formed when the yarn is elongated to a breaking level is very small. This means that the free ends formed during the raising operation stands together closely in the straight-forward state thus enabling one to obtain a velour or velvetin-like raised fabrics. In contrast, conventional polyester yarns have a comparatively large amount of snap back power and therefore, straight-forward free ends are much difficult to obtain.

An explanation will be made with regard to a raised commingled yarn. A velour-like textured yarn can be obtained by raising a heat-relaxed commingled yarn comprising the yarn of the invention and a multifilamentary yarn having a boil-off shrinkage of at least 6% higher than the said yarn and not less than 12%. In this case said heat-relaxation causes the low shrinkage filaments lie outwardly to form into loops, coils and so on, and these loopy portions are cut into free ends during the raising operation. The loopy yarn can be obtained by heat-relaxing at least two kind of filamentary yarns different in a boil-off shrinkage in doubled state e.g. at the same overfeed ratio, causing a differential length among constituent filaments in the doubled yarn, then interlacing said heat-relaxed yarn wherein longer (more overfed) filaments are converted into loops, coils and curls, etc. In another example, the above yarns are first interlaced together at the same overfeed ratio, then the formed commingled yarn is heat-relaxed to result in similar loops increased in loop density and height. From the view point of obtaining the effect of loop formation abovementioned, it is necessary that at least 6% difference in a boil-off shrinkage between the yarns and also the high shrinkage yarn has a boil-off shrinkage of at least 12%. The former value is a minimum condition for occurrence of differential length among the filaments, the latter value is a minimum condition to cause differential length among the filaments.

An embodiment of the invention regarding such raised commingled yarns comprises the steps of:

(i) heat-relaxing both of the high shrinkage yarn and the low shrinkage yarn together on a heater located between the first roll system and the second roll system which rotates in a lesser peripheral speed than said first roll system. The heat-relaxed yarn consists essentially of filaments different in length (different overfeed ratio), (ii) subjecting the above heat-relaxed yarn to a whirling action of turbulent fluid between said second roll system and the third roll system to form a loop yarn, (iii) raising said loop yarn by slidably contacting it to a rotating grinder located between said roll system and the fourth roll system, and (iv) winding the raised yarn upon a bobbin.

In the above, the second roll system may be omitted for the variation thereof. Also the heat-relaxing and the interlacing may be replaced each other.

As is well known to ones in the art, the commingled yarn is imparted interlaced tie points intermittently along the yarn length and, therefore protrutions in the form of loops and arches are formed between adjacent interlaced points when said commingled yarn is heat-relaxed. Accordingly the height of the loops can be even altered by adjusting said interlaced points or coherency factor in the range of 20/meter to 80/meter.

Further, much more loops and arches are expected to obtain upon heat-relaxing a loopy yarn which has been produced previously by introducing both component yarns to a turbulent zone under a overfed state.

The above is an example of the continuous process, but each step of (i), (ii), (iii) and (iv) may be carried out separately. In an extreme embodiment, a commingled yarn may be subjected to a raising operation in the form of a knitted or woven cloth.

There is no limitation of a yarn of the high shrinkage so far as it has a boil-off shrinkage of at least 12%. Generally a non-set polyester yarn obtained by hot-drawing an undrawn yarn without a subsequent heat-setting for the drawn yarn, or by spinning a partially oriented yarn, optionally further cold-drawing said yarn is employed.

For a commingling of two yarns, an interlace or "Taslan" treatment well known in the art is employed. These processes are described in detail in the specification of U.S. Pat. No. 2,985,995 and 2,783,609, respectively.

As raising means, conventional raising machines for knitted or woven good and raising devices for yarns may be employed. Examples of the latter include a static or rotating body upon the surface of which particles of diamond and/or carborundum being fixed or the surface of which is composed of materials with a higher friction such as metal rasp and brush.

In accordance with the present invention, it is possible to obtain a higher loop density wherein the loop size can be easily altered to a desired degree. Therefore, a raised commingled yarn have a wide range of free ends in length, e.g. from the higher extreme to the lower extreme. Still the filaments of the low shrinkage to be raisen are interlaced with the other filaments (of the high shrinkage) to result in an anchor effect, the fear for drop-off of the free ends is substantially overcome.

Next, an explanation is made with reference to a raised cloth comprising the yarn of the invention. Said filamentary yarn should have a tenacity of no more than 5 grams per filament (preferably 0.3 gram to 3 grams). When the filamentary yarn have a tenacity exceeding 5 grams per filament, it shows comparatively higher resistance to filament break during a raising operation and accelerates snap back motion of broken free ends and therefore, free ends of the straight-forward state can not be expected. The above filamentary yarn with the lower tenacity can be easily obtained by adjusting a filament denier in lower value.

The filamentary yarn of the invention is to be used is such that it constitutes at least a surface portion of a cloth. Said cloth may be arbitrarily selected from the group consisting of a woven, knitted and non-woven fabric. Especially in case of a woven fabric it is preferable to employ the satin fabric in which the filamentary yarns are used as the weft in $\frac{1}{3}$ weave structure. A double-face woven fabric in the weft direction may be another example. In case of a warp knitted fabric, a satin tricot structure made by means of double-bars or triple-bars system is preferable in which structure the filamentary yarn of the invention has float-stiched over at least three successive needles (satin tricot in 1–3). In case of a weft knitted fabric, such as interlock stitch, mock-rodier, etc., in which the filamentary yarn of the invention is stitched at at least one face are preferable.

As clear from the above, the filamentary yarn of the invention is applied to as the float component in each of the structure to promote easy raising and accordingly, said yarn should have the lower boil-off shrinkage, say no more than 7.5%. As rasing means, any known means such a wire system, a sand paper system, etc. may be employed.

In the invention, a raised cloth can be obtained having improved lustre and appearance owing to the existance of free ends protruding straight-forwardly. This is because no bending phenomena occurs when the filaments of the invention are broken during the raising since a tenacity of the said filaments is lower, namely, no more than 5 grams per filament and also an amorphous orientation of the same is in the lower range of 30% to 70% than conventional yarns.

As another merit of the above raised cloth, the free ends existing thereupon can be easily heat-set in the desired direction, by making use of the ameliorated heat-setting property of the free ends (broken filaments) having negative $\epsilon_{0.2}$ in addition to the above mentioned range of tenacity and amorphous orientation.

Thus a raised cloth with a fluffy layer of an improved hand in addition to lustre and appearance can be realized by brushing all the free ends existing in straight forward form without bending into a state of standing close in the desired direction and heat-setting said state.

One of the features of the filamentary yarn of the invention is that it has an improved heat-setting property. In other words, said yarn, if subjected to heat-setting treatment in a deformed state, will retain the deformed state easily after it has been heat-set. By making use of said thermal property and further fine filaments of the filamentary yarn of the invention, silk-like light fabric such as a scarf can be prepared easily even in a light weight since a grey fabric maintains its original structure during heat-setting and heat-set yarns constituting said fabric never slip at the interstices in subsequent processing. In contrast, trials to make a coarse fabric such as light fabric and scarf from conventional yarns have been unsuccessful since slip occurs between the warp and the weft where they go over and down each other. As the result, the interstices of the fabric are destroyed to result in an unsatisfactory good.

The improved thermal property of the filamentary yarn of the invention also finds another valuable application to the preparation of a fabric with extremely soft and resistant to air permeability. For example, when a fabric resistant to air permeability such for use as wind breaker materials is tried to prepare by heat-filling the interstices of a heavy fabric interwoven in a higher density using conventional polyester yarns, it is necessary to heat-pressing the fabric to convert the constituent yarns into a flat in cross section by effecting said heat-filling by means of a pair of calender rolls, hot-plate press machine, etc. under high temperature and pressure. This treatment imposes the fabric heavy thermal influence and the treated fabric shows a paper-like appearance and touch as its defect. On the contrary, as in fabric comprising the yarns of the invention can be easily heat-filled even under low temperature and pressure to produce a desired anti air-permeability, the treated fabric presents an improved hand free from the paper-like hand and also an enhanced anti air-permeability as well as soft touch attributable in part to the extra fine filaments.

Also, in view of the improved heat-setting property of the filamentary yarn of the invention, it is preferably heat-set temporarily in a hard (high) twist state. Therefore, the heat-set yarns can be woven or knitted into an article without the handling trouble due to torque of the twists and said article (cloth) developes sufficient torque of the hard twisted yarns upon relaxation treatment in hot water. Regarding hard twist, the filamentary yarn of the invention, bears high twist-resistance to the harder twists to be imparted thereto. When the torque of such harder twist is temporarily set by means of a sizing and the set yarn is woven into a fabric, the fabric reproduces, upon relaxation, well creped surface consisting of quite little convex crimps with round edges.

As requisites of the yarn to be hard twisted, it should have a fineness of no more than 0.9 denier per filament (preferably 0.1 denier–0.6 denier), an amorphous orientation (fa) of 30% to 70%, an structural integrity parameter ($\epsilon_{0.2}$) of less than zero but no less than $-0.025$ and a boil-off shrinkage of no more than 7.5%. When the boil-off shrinkage excesses 7.5%, the yarn tend to shrinks excessively and free movement of the yarns is hindered. The more the movement is lowered, the less the torque of the hard twist developes to produce a poor creped effect. Also, when the fineness exceeds 0.9 denier per filament, the crepe fabric is never imparted silk-like pliant hand as well as draperbility. Further, the amorphous orientation (fa) over 70% causes an increase of molecular coagulation in the amorphous phase which in turn brings about a decrease of the twist resistance of the yarn. On the other hand, the amorphous orientation below 30% means a poor orientation of molecules in the amorphous phase which in turn bring about a insufficient modulus of the yarn. In this case the yarn lowers in twist resistance and therefor a large amount of torques are never expected after the yarn is hard twisted to high level of twist. Regarding $\epsilon_{0.2}$, in case that it is zero or positive, the yarn tends to extend spontaneously upon heat-relaxation in hot water of the fabric comprising said yarn and an extra consideration must be paid to, in spite, the heat-relaxed fabric shows poor crepe. On the other hand, $\epsilon_{0.2}$ below $-0.025$ causes the yarn to shrink excessively upon heat-relaxation in hot water to produce heavy contact pressure between the yarns. In this case, developement of torque becomes insufficient to produce only a poor crepe effect.

For the preparation of hard twist crepe (or crepe de Chine), the yarn of the invention is first twisted to high level of twist. The number of twist may be selected generally from the range of 14,000 twists per meter to 35,000 twists per meter although said number depends upon a desired quality of a final good and a fineness of the yarn, etc. Since the hard twisted yarn imparted the number of twist within said range bears considerable amount of torque in potential which makes weaving or knitting operation difficult, it is desirable to fix said twist temporarily prior to said operations. As an example of temporary fixing the twist, such method can be cited which comprises steps of:

(i) applying previously a low viscous sizing agent (preferably 3 centipoises–10 centipoises) such as starch, polyvinyl alcohol and polyacrylate, etc., to the yarn of the invention, (ii) then, hard twisting said sized yarn, and (iii) finally, applying again the above mentioned sizing agents to the hard twisted yarn. Another example of fixing the twist comprises a heating the hard twisted yarn at a low temperature of 40° C. to 70° C. under wet condition or at a temperature of 40° C. to 80° C. under dry condition.

Concerning the structure of a crepe cloth, there is no limitation so long as it is conventional in creping, but preferably a plain weave on knit is adopted to the utmost.

In cloths thus obtained in which the hard twisted yarns with a boil-off shrinkage of no more than 7.5% are used while said twist is temporarily set, a contact pressing powder between the yarns is very small, therefore, upon heat-relaxation of the cloths in hot water well creped cloths can be obtained reproducing torque of the yarn again. Said relaxation may be carried out by dip-stirring the cloths while relaxing the same, for example, in about 100° C. water for a time of 20 minutes to 30 minutes.

An advantage of the yarn of the invention in connection with sizing effect, resides in its ability to retain larger pick-up ratio upon the yarn. Said larger pick-up is brought about in synergistic effect of a extra fineness of the filament and an increased surface of the yarn comprising a bundle of said filaments. Namely, a size can easily penetrate among the extra-fine filaments by a capillary effect induced among said filaments and overall pick-up of the size penetrated increases due to the large surface of the yarn. Therefore the size adhered on the surface of an individual filament serves for effective fixing of the twist. This mechanism abandons on adoption of the higher temperature used in conventional fixing of twist.

The lower temperature preferably used in the invention prevents releasement of stress induced in the yarn by hard twist, so the strong torque can be reproduced upon relaxation of the temporarily set-yarn to produce an evenly creped surface without defect in uneven shrinkage as well as width shortage of the fabric. Further the use of the extra fine filaments gives silk-like pliant hand and draperbility upon the creped fabric in addition to uniform and minute crepes (crimps). Further, as pointed out hereinbefore, as the yarn of the invention can be imparted high level of twist, this state of twist accelerates said crimps into more minute, uniform and higher level.

As the other advantage of the yarn of the invention, its improved dimensional stability and heat-setting property are added. These contributes to provision of a crepe fabric stabilized in its dimension, and the latter also contributes to an improvement in even and heightened crepe since the yarn is easily set under the lower temperature.

Apart from crepe cloths, the false twist crimping under high twist-coefficient ($\alpha$) is made possible. Generally said twist coefficient $\alpha$ is expressed by the following formula;

$$\alpha = T_f\sqrt{De/32500}$$

wherein $T_f$ is the number of twists per meter and De is a total denier fo the yarn to be false-twisted. The value of $\alpha$ applied for in the false-twist crimping of conventional crystalline polyester yarn has been up to 0.9 and even for a partially oriented yarn of extra fine filaments spun at high speed said value ($\alpha$) only reaches up to 1.1. When $\alpha$ exceeds 0.9 or 1.1 in each occasion, fuzz or yarn break arises to hinder further crimping. On the contrary, the yarn of the invention enables one to employ $\alpha$ over 1.1 in spite of being crystalline. Thus false twist crimped yarn obtained under the higher twist coefficient has filaments crimped in very small crimp amplitude and presents extremely soft touch and hand in combination with the extra fineness of individual filament. In addition, a knitted fabric made from such crimped yarn shows a lowered value compared to conventional goods.

Chemical treatments for anti-static, anti-soiling, anti-flaming or smoothing are advantageously applied to the yarn of the invention, by which a permanent durability of the chemicals can be obtained on the yarn since the chemicals are easily adhered to individual filament due to their extra fineness and small crimp amplitude.

The abovementioned various features possessed and effects realized by the yarn of the invention are attributed to a fact that said yarn, in spite of being crystalline, has a quite different amorphous plase in its structure from conventional crystalline yarns. Namely, said amorphous phase is characterized by an amorphous orientation (fa) of 30% to 70% (preferably 30%–70%) according to the invention. A yarn with a value of (fa) less than 30% decreases in twist-resistance while a yarn with said value over 70% deteriorates its dimensional stability, heat-setting property and rasing property.

In a yarn as spun at the lower spinning speed, it is impossible to obtain an amorphous orientation (value) by analysis since no crystal developes substantially in the filaments and a crystalline phase can not generally distinguished from a amorphous phase. Even the yarn consisting of a bundle of extra fine filaments spun at a spinning speed of 3000 meters/minute or more only bears negligible (fa) value impossible to be calculated and only a few percents for said (fa) is recognized in the filaments spun at an extra high spinning speed of about 5000 meters/minute to 6000 meters/minute. In contrast, a drawn yarn of extra fine filaments obtained through a drawing and subsequent heat-setting operation has (fa) value exceeding 70%. In such yarn, molecules of the amorphous phase are in strained state and thereby, a coagulation energy of said phase is very high.

Thus, the yarn of the invention is distinctly extinguished in its amorphous orientation value from heretofore known ones and possesses an improved processability in a heat-setting, a raising property, a dimensional stability, and a twist resistance.

In addition, the yarn of the invention has a negative $\epsilon_{0.2}$ (preferably, $0>\epsilon_{0.2}\geqq-0.025$). This negative $\epsilon_{0.2}$ means, as will be apparent from the definition thereof, that the yarn shrinks positively in hot or boiling water even under load. Generally, a yarn of extra fine filaments spun at a spinning speed of about 3000 meters/minute or more has a positive $\epsilon_{0.2}$, namely, it is characteristic of spontaneous extending property.

Therefore, an extra consideration is required due to said behavior of the yarn in the relaxation stage. While the yarn in accordance with the invention shrinks in hot or boiling water as the conventional heat-set drawn yarns does and may be subjected to an usual relaxing operation without extra consideration. Still, the present yarn has a higher value for $\epsilon_{0.2}$ (less shrinkable), by which an excellent dimensional stability is secured. The value for $\epsilon_{0.2}$ itself depends on the state of an amorphous phase which bridges crystalline phases existing in fibre structure, accordingly it will be quite apparent that the present yarn is different in (fa) from a high speed spun yarn or a heat-set drawn yarn heretofore proposed.

In the below, an explanation will be made regarding the definition and the determination method of the parameters used in this invention.

(1) Amorphous orientation (fa): The above is defined as, $$fa=[\Delta n-0.212fc\ X_\rho/0.195(1-X_\rho)]$$

where $\Delta n$ is birefringence value determined by "Senarmont" Method using a polarizing microscope, fc is a crystalline orientation determined by wide angle X-ray diffraction techniques and $X_\rho$ is the crystallinity derived from the density of the yarn.

(2) Structural Integrity Parameter ($\epsilon_{0.2}$):

This is determined according to a test method disclosed in the specification, lines 39 to 49, the fourth column of U.S. Pat. No. 3,771,307.

First, a weight of 0.2 gram/denier is suspended on an end of a specimen yarn and the length ($l_0$) is measured under the load. Then, said yarn under the load is immersed into boiling water for 2 minutes, thereafter removed, and cooled. Again, the length ($l_1$) of the cooled yarn is measured.

Using $l_0$ and $l_1$, $\epsilon_{0.2}$ is defined as follows, $$\epsilon_{0.2}=(l_1-l_0/l_1)$$

A negative $\epsilon_{0.2}$ means that a yarn shrinks in boiling water.

(3) Boil-Off Shrinkage (B.O.S.):

This is measured according to JIS L1073. First, a weight of 1/30 gram/denier is suspended on an end of a sample yarn and its length ($L_0$) is measured. Then, the yarn free from said weight is immersed into boiling water for 30 minutes, thereafter, removed and cooled to an ambient temperature. Again the same weight (1/30 gram/denier) is suspended said cooled yarn and its length ($L_1$) is measured. Here, boil-off shrinkage (B.O.S.) is calculated by the following formula, $$B.O.S.=(L_0-L_1/L_0)\times 100\ (\%)$$

(4) Crystallinity ($X_\rho$):

This is expressed by the following formula, $$X_\rho=(\rho-\rho_a/\rho_c-\rho_a)\times 100\ (\%)$$

where $\rho$ is the observed density of the sample fibre, $\rho_a$ is the observed density of a completely amorphous sample, $\rho_c$ is the observed density of a completely crystalline sample.

The observed density ($\rho$) is measured by use of the density gradient tube using a mixture of carbon tetrachloride and n-heptane as the liquids. Also, the theoretical value of 1.455 for $\rho_c$ and 1.335 for $\rho_a$ are used, respectively.

(5) Density ($\rho_a$) of an amorphous phase:

This is calculated by the following formula, $$\rho_a=[1.455(1-X_x)\rho/1.455-X_x\rho]$$

where $\rho$ is as same as defined in the previous section (4), $X_x$ is the crystallinity measured according to wide X-ray diffraction method commonly used in the art.

(6) Slight Coherency Factor ($CF_S$):

One end of a sample yarn 150 centimeters long is fastened to a hook from which the yarn is hanged down in dead weight on the other end thereof. At an upper end of the yarn, the yarn bundle is separated in half. Into this separation, is a weighted hook inserted having a total weight in grams numerically equal to the value obtained through the formula:

$$\text{Weight in grams} = \frac{\text{Total denier} \times \text{Total number of filaments}}{90{,}000}$$

The weighted hook is then lowered at a rate of 3 to 5 centimeres per second until the hook is supported by the resistance of the yarn to further passage of the hook down the yarn.

Further, the hook is removed from the resting point and again inserted into the yarn bundle at a point 5–10 millimeters below the resting point to repeat said lowering operation of the hook. Thus, the hook drop distance (centimeter) thereby traversed through the yarn bundle is recorded until 20 results are obtained in succession, thereafter an average value ($\overline{X}$) in centimere is taken based upon the results.

The slight coherency factor ($CF_S$) is 100 divided by this average value ($\overline{X}$) namely, $CF_S = 100/\overline{X}$ The above slight pin count test is useful for measuring an extremely slight interlace-point which is never inspected accurately by the hook-drop test (U.S. Pat. No. 2,985,995) or the automatic pin count test (U.S. Pat. No. 3,290,932).

For reference, the measuring capacity of these test systems for the same yarn is added as follows:

| Test | CF | $CF_S$ |
|---|---|---|
| Slight pin count test | — | 5–40 |
| Hook-drop test | 0–1.8 | — |
| Automatic pin count test | *(160–500) | — |

*Unit is centimeter.

The following examples further illustrate the invention in detail, although they are not intended to be limitative. Also, evaluations of the processability of yarns if based upon the following tests.

(7) Raising property (R.P.):

A satin fabric in $\frac{1}{3}$ weave is made from sample yarns and said fabric is raised 9 times by a wire-raising machine of oil-pressure type. The raised fabric thus obtained is evaluated functionally with regard to both density and appearance of free ends (fluffs or naps) formed.

| Density | Appearance | Evaluation |
|---|---|---|
| High | Excellent | ◎ |
| High | fair | 0 |
| fair | fair | Δ |
| poor | poor | x |
| (no practical use) | | |

(8) Heat-setting property (H.S.P.):

A specimen yarn is twisted to 3000 turns/meter. A weight of 1 mg/denier is suspended on the middle point of said twisted yarn cut into 70 cm in length. Then, said yarn is folded in half and the other end is fastened to a proper fixing device while said load is suspending therefrom. In this state the specimen yarn is left to rotate freely due to its torque to form a plied yarn. When the yarn ceases to rotate, both ends of the same is grasped and fixed to a twist inspector at each end under a tension of 0.1 gram/denier. The yarn is, then, untwisted opposite the former rotation thereof, measuring the number of untwisting as $T_1$ turn/25 cm.

On the other hand, a specimen sample is twisted to 3000 turns/meter and steam-set at 80° C. for 20 minutes. Then torque ($T_2$) of said yarn is measured in the same manner described above. Using $T_1$ and $T_2$, the heat-setting property (H.S.P.%) is calculated by the formula, $$\text{H.S.P.} = (T_2/T_1) \times 100\ (\%)$$

The lesser the value of H.S.P. becomes, the more the yarn is easily heat-set regarding the twist imparted thereto.

(9) Dimensional Stability (D.S.) . . . Dry heat shrinkage at 180° C.

This is determined according to JIS L 1073. A weight of 1/30 gram/denier is suspended on an end of a sample yarn and the length ($L_0$) under the load is measured. Then the weight is removed and the sample yarn is hanged for 15 minutes in a drier chamber heated to atmospheric temperature of 180° C. Then, the yarn is taken out and cooled to a ambient temperature. Again, the weight of 1/30 gram/denier is loaded upon the yarn and the length ($L_1$) is measured. Using $L_0$ and $L_1$, the dimensional stability (D.S.%) is calculated in the formula, $$\text{D.S.} = (L_0 - L_1/L_0) = 100\ (\%)$$

(10) Twist-Resistance [$R_t$(turn/meter)]

This is measured according to JIS 1037–60. A sample yarn under a load of 1/30 gram/denier is twisted until it is twisted off. Twist-Resistance is designated by $R_t$ turns/meter given when the yarn is twisted off.

Examples 1–7 and comparative Examples 1–7

Polyethylene terephthalate containing 0.3%, by weight, of $TiO_2$ based on the polymer and having a intrinsic viscosity of 0.64 measured in orthochlorophenol at 35° C. is melt-spun at 298° C. through a spinneret having 72 orifices. The spun yarn is quenched to be solidified by cooling air blowing transversely while traveling through a spinning stack, and then finishing agents is applied to the yarn by a applicator roll. The finished yarn leaving said roll is withdrawn by a pair of godet rolls and fed to "Nelson" type heated rolls around which the yarn is turned to receive heat-setting treatment. Finally, it is wound up on a bobbin.

In the above process, the following four conditions are varied in such range as shown in Table-I.

[$SD_r$] . . . Spinning draft ratio. This is altered by changing a diameter of the orifice.

[$S_w$] . . . Withdrawal speed (meter/minute) by the pair of godet rolls

[$ST_r$] . . . Yarn stretch ratio (%) betwen the pair of godet rolls and "Nelson" type heated rolls

[Tn] . . . Surface temperature (°C.) of the above heated rolls.

In Table-I, both of yarn properties and yarn processability are also added to.

Further, Comparative Example 1 is carried out according to Example 1 of the specification of Japanese patent application having Laid-open No. 35216/1972 wherein a solidified yarn by the cooling air is heat treated through a hollow tube heated to 200° C. and located between the spinning stack and the applicator roll, and wound up on the bobbin at a winding speed of 3,500 meters/minute.

a cooling air blowing transversely while traveling through a spinning stack, and then finishing agents is applied to the yarn by an applicator roll. The finished yarn leaving said roll is withdrawn by a pair of godet rolls at a withdrawal speed of 3,800 meters/minute and fed to "Nelson" type heated rolls around which the yarn is turned to receive heat-treatment for 0.03 second. Finally it is wound up on a bobbin.

Table I

| | Spinning Conditions | | Heat-Relaxing Conditions | | Yarn Properties | | | Processing Properties | | | |
|---|---|---|---|---|---|---|---|---|---|---|---|
| | $SD_r$ | $S_w$ (m/min.) | $ST_r$ (%) | $T_n$ (°C.) | de* | f(a) (%) | $\epsilon_{0.2}$ | R.P. | H.S.P. (%) | D.S. (%) | $R_t$ (T/m) |
| Comparative Example 1 | | | | | 0.50 | 28 | −0.01 | 0 | 14.3 | 7.5 | 3,570 |
| Comparative Example 2 | 200 | 2,200 | 0.3 | 160 | 0.50 | 28 | −0.01 | Δ | 15.0 | 20.1 | 3,260 |
| Example 1 | 350 | 3,000 | 0.3 | 160 | 0.50 | 32 | −0.01 | ◎ | 15.8 | 11.2 | 4,420 |
| Example 2 | 430 | 3,400 | 0.3 | 160 | 0.50 | 50 | −0.01 | ◎ | 18.6 | 9.6 | 4,360 |
| Example 3 | 500 | 3,800 | 0.3 | 160 | 0.50 | 68 | −0.01 | ◎ | 22.4 | 8.2 | 4,150 |
| Comparative Example 3 | 220 | 1,000 | 275.0 | 180 | 0.50 | 72 | −0.01 | x | 35.6 | 15.1 | 3,530 |
| comparative Example 4 | 160 | 1,300 | 155.0 | not heated | 0.50 | 50 | 0.003 | 0 | 9.7 | 26.0 | 3,370 |
| Example 4 | 430 | 3,400 | 0 | 160 | 0.50 | 50 | −0.006 | ◎ | 15.2 | 10.7 | 4,390 |
| Example 5 | 430 | 3,400 | 10.0 | 160 | 0.50 | 50 | −0.023 | ◎ | 20.3 | 7.9 | 4,040 |
| Example 6 | 430 | 3,400 | 20.0 | 160 | 0.50 | 50 | −0.028 | 0 | 30.4 | 6.8 | 3,520 |
| Example 7 | 680 | 3,400 | 0.3 | 160 | 0.70 | 50 | −0.01 | 0 | 20.8 | 11.6 | 3,620 |
| Comparative Example 5 | 1,020 | 3,400 | 0.3 | 160 | 1.00 | 50 | −0.01 | x | 23.7 | 13.2 | 3,480 |
| Comparative Example 6 | 680 | 3,400 | 0.3 | 160 | 1.00 | 35 | −0.008 | x | 13.0 | 13.2 | 3.320 |
| Comparative Example 7 | 500 | 3,800 | 0 | not heated | 0.50 | — | 0.016 | x | 0 | 75.5 | 2,360 |

*denier per filament

As can be understood from the table, the linear crystalline polyester filamentary yarn possesses excellent behavior common to a raising property, a heat-setting property, a dimensional stability and a twist resistance so far as said yarn satisfies following (a), (b) and (c) concurrently.

(a) a fineness of 0.9 denier/filament or less, (preferably 0.6 denier/filament or less)

(b) an amorphous orientation in the range of 30% to 70%

(c) a negative $\epsilon_{0.2}$ (preferably $0 > \epsilon_{0.2} \leqq -0.025$).

Examples 8–14 and Comparative Example 8

Polyethylene terephthalate containing 0.3% by weight, of $TiO_2$ based on the polymer and having an intrinsic viscosity of 0.68 measured in ortho-chlorophenol at 35° C. is melt-spun at 303° C. through a spinneret having 72 orifices each of which is 0.15 mm in diameter. The spun yarn is quenched to be solidified by In the above, a draft ratio ($SD_r$) is 420. Further, a surface temperature ($T_n$°C.) of the heated roll and the conditions ($ST_r$) defined hereinbefore is varied as shown in Table-II. Also in the table, both yarn properties and yarn processability are added to.

TABLE II

| | Heat-Stretching Conditions | | Yarn Properties | | | | | | Processing Properties | | | |
|---|---|---|---|---|---|---|---|---|---|---|---|---|
| | $ST_r$ | $T_n$ (°C.) | de* | f(a) (%) | $\epsilon_{0.2}$ | B.O.S. (%) | $\chi_\rho$ (%) | $\rho_a$ (g/cm³) | R.P. | H.S.P. (%) | D.S. (%) | $R_t$ (T/m) |
| Example 8 | 0.3 | 120 | 0.44 | 36 | −0.007 | 11.2 | 21 | 1.328 | 0 | 14.3 | 14.6 | 3,690 |
| Example 9 | 0.3 | 130 | 0.43 | 43 | −0.012 | 9.1 | 27 | 1.338 | 0 | 15.4 | 12.2 | 3,870 |
| Example 10 | 0.3 | 160 | 0.45 | 61 | −0.016 | 7.4 | 34 | 1.345 | ◎ | 16.1 | 10.5 | 4,390 |
| Example 11 | 0.3 | 180 | 0.44 | 68 | −0.021 | 4.6 | 39 | 1.351 | ◎ | 16.8 | 7.1 | 4,070 |
| Example 12 | 5 | 140 | 0.42 | 44 | −0.013 | 8.3 | 28 | 1.354 | 0 | 15.7 | 11.4 | 3,910 |
| Example 13 | 12 | 140 | 0.39 | 62 | −0.017 | 6.6 | 32 | 1.342 | ◎ | 19.3 | 9.8 | 4,310 |
| Example 14 | 19 | 140 | 0.37 | 69 | −0.023 | 4.2 | 40 | 1.336 | 0 | 26.5 | 6.7 | 3,990 |
| Comparative Example 8 | 22 | 140 | 0.36 | 72 | −0.029 | 3.5 | 45 | 1.330 | Δ | 24.3 | 4.3 | 3,540 |

*denier per filament

As can be easily understood, when the yarn further possesses a boil-off shrinkage of no more than 10%, $X_\rho$ of no less than 30% and a density of no less than 1.335 grams/cm³ for the amorphous phase in addition to the basic requisite of (a), (b) and (c) in the previous example, it shows more preferable processabilities.

EXAMPLE 15

The example illustrates the production of a textile fabric from a commingled yarn of the invention.

[I] Production of a commingled yarn.

(i) Combination of yarns

| | |
|---|---|
| Component (A) | Polyethylene terephthalate filamentary yarn of 30 deniers, 70 filaments<br>$\epsilon_{0.2} = -0.016$<br>f(a) = 62%<br>$\rho_a = 1.3450$ grams/cm$^3$ |
| Component (B) | Polyethylene terephthalate drawn filamentary yarn of 30 deniers, 12 filaments<br>$\epsilon_{0.2} = -0.034$<br>f(a) = 76%<br>$\rho_a = 1.3129$ grams/cm$^3$ |

Component (A) is obtained by melt-spinning a polyethylene terephthalate having a intrinsic viscosity of 0.61 at 295° C. through a spinneret with 70 orifices, each 1.5 mm in diameter under a draft ratio of 420 and wound up at a winding speed of 3800 meters/minute. Before being wound up, the spun yarn is heat-set for 0.03 second on a tapered roll heated to 170° C. under a stretch ratio of 2%.

Component (B) is obtained according to a conventional method of spinning, and drawing in separate using the same polyethylene terephthalate as in case of the component (A) where an undrawn yarn is wound up at a winding speed of 1500 meters/minute, then the undrawn yarn is further subjected to a heat-drawing at a draw ratio of 3.5 and a temperature of 85° C.

(ii) Production of a commingled yarn

Both component (A) and (B) are doubled and overfed by 0.3% to an interlace nozzle of FIG. 3 in U.S. Pat. No. 2,985,995, supplied with air having a pressure of 3.1 Kg/cm$^2$.G. Coherency Factor of the commingled yarn obtained is 60 in usual Fook-drop test described in the above Patent.

[II] Production of a fabric of plain georgette

The above commingled yarns are used as the warp in end spacing of 69/cm and as the weft in pick spacing of 38/cm, and a grey fabric woven are relaxed in 97° C. water for 12 minutes by use of a rotary washer.

Next, the fabric is pre-set while being overfed by 3% in the warp direction and then subjected to an alkaline reduction treatment in an aqueous solution of NaOH (18 grams/liter), for 25 minutes. The treated fabric, as a whole, resembles silk with respect to hand, surface texture, touch and draperbility.

EXAMPLE 16

Both high-shrinkage filamentary yarn and low-shrinkage filamentary yarn listed below, are doubled and introduced into a turbulency nozzle to obtain a loop yarn located between the first roll system for feeding said yarns and the second roll system for withdrawing the loop yarn, and said loop yarn is continuously heat-relaxed on a heater located between said second roll system and the third roll system, a relaxed yarn further being raised by a rotating grinder located between said third roll system and the fourth (final withdrawal) roll system, then wound up on a bobbin.

The details in the above are as follows:

[I] Combination of yarns (1) High-shrinkage filamentary yarn

Partially oriented polyethylene terephthalate of 50 deniers, 36 filaments, boil-off shrinkage of 65%.

(2) Low-shrinkage filamentary yarn

Polyethylene terephthalate filamentary yarn of 32 deniers, 72 filaments, boil-off shrinkage of 4.5%, f(a) of 62% and $\epsilon_{0.2}$ of $-0.021$.

The above low-shrinkage filamentary yarn is obtained by melt-spinning a polyethylene terephthalate having an intrinsic viscosity of 0.61 at 295° C. through a spinneret with 72 orifices, each 0.15 mm in diameter under a draft ratio of 450 and wound up at a winding speed of 3800 meters/minute. Before being wound up, the spun yarn is heat-set for 0.03 second on a tapered roll heated to 170° C. under a stretch ratio of 2%.

[II] Processing conditions

| | |
|---|---|
| (3) Peripheral speed of the first roll system | 80 meters/minute |
| (4) Peripheral speed of the second roll system | 73.6 meters/minute |
| (5) Overfeed ratio between the above two roll systems | 8% |
| (6) Turbulency nozzle | same type as of FIG. 3 in U.S. Pat. No. 2,783,609 (air pressure of 4 Kg/cm$^3$ . G) |
| (7) Heater temperature | 180° C. |
| Heater length | 100 cm |
| (8) Peripheral speed of the third roll system | 29.4 meters/minute |
| (9) Overfeed ratio between the second and the third roll system | 60% |
| (10) Raising body | 150 meshes in surface roughness |
| (11) Winding speed | 31.5 meters/minute |

[III] Properties of loop yarn and raised yarn

| | |
|---|---|
| (12) Number of loops before heat-relaxing | 18/cm |
| (13) Number of loops after heat-relaxing | 46/cm |
| Average height of loops | 3.6 mm |
| (14) Number of remaining loops after raising | 12/cm |
| (15) Number of free ends (fuzzes) after raising | 50/cm |
| (16) Average length of free ends after raising | 5.2 mm |

In the raised yarn, free ends are protruding straight-forwardly, each being in non-crimped state. Thus, the yarn seems to possess, visibly a plenty of fuzzes long in length where an entanglement of fuzzes or a pilling is not recognized. Further, the yarn shows an extremely pliant (supple) silk-like hand.

Example 17 and Comparative examples 9–10

Polyethylene terephthalate having an intrinsic viscosity of 0.65 and containing 0.3%, by weight, of $TiO_2$ based upon the polymer is melt spun at 298° C. through a spinneret having 72 orifices under a draft ratio of 420, and wound up at a speed of 3800 meters/minute. The yarn of 72 filaments has an average denier of 0.44 per filament.

In the above, the spun yarn is quenched to be solidified by cooling air blowing transversely while traveling through a spinning stack, then imparted finish agents by an applicator roll, and withdrawn by the first and the second godet roll successively. The yarn is further heat-set being turned around the second godet roll and a pair of "Nelson" type heated roll (surface temperature of 210° C.) where both rolls rotate at the same peripheral speed.

The yarn thus obtained is doubled and used for the production of a plain fabric in end spacing of 40/cm and in pick spacing of 36/cm, respectively. A grey fabric thus produced is finished as usual, thereafter pressed by introducing it into a nip of calender rolls heated to 100° C. (day heat) under a pressure of 10 Kg/cm$^2$. The heat-pressed fabric possesses an extremely soft hand in addition to an improved resistance to air permeability.

For comparison, a grey fabric having the same cover fator as in the above example as produced using a polyester yarn 75 deniers, 36 filaments on the market and heat-pressed in the same manner described above. The heat pressed fabric shows only a poor resistance to air permeability (Comparative example 9).

Further, said fabric is again heat-pressed by the calender rolls employing a more severe condition, namely a temperature of 180° C. and a pressure of 30 Kg/cm$^2$. In this case, the resistance to air permeability is considerably improved, in stead, the handle of the fabric is uselessly paper-like (Comparative example 10). Results are shown in Table-III below.

Table III

| | Items | | Example 17 | Comparative Example 9 | Comparative Example 10 |
|---|---|---|---|---|---|
| Yarn | Polymer | | Polyester | Polyester | Polyester |
| | Total denier | de | 64 | 75 | 75 |
| | Number of filaments | | 144 | 36 | 36 |
| | Denier per filament | de | 0.44 | 2.1 | 2.1 |
| Yarn | fa | % | 68.4 | 77.2 | 77.2 |
| structure | $\epsilon_{0.2}$ | — | −0.013 | −0.030 | −0.030 |
| Weaving | End spacing | End/cm | 40 | 37 | 37 |
| conditions | Pick spacing | Pick/cm | 36 | 33 | 33 |
| | Design | — | plain | plain | plain |
| Calender | Temperature (dry) | °C. | 100 | 100 | 180 |
| roll | Pressure | Kg/cm$^2$ | 10 | 10 | 30 |
| Fabric | Air Permeability | cc/cm$^2$/sec | 0.6 | 5.9 | 1.2 |
| | Hand (softness) | | ◎ | Δ | x |

In the table, the handle is examined as follows.
◎almost free from being paper-like and extremely soft.
Δ slightly paper-like
x extremely paper-like and poor handle.

Example 18 and Comparative examples 11–12

Polyethylene terephthalate having an intrinsic viscosity of 0.64 and containing 0.3%, by weight, of $TiO_2$ based upon the polymer is melt-spun at 298° C. through a spinneret having 72 orifices. The spun yarn traveling through a spinning stack is quenched to be solidified by cooling air blowing transversely, then imparted finish agents by an applicator roll. The finished yarn is withdrawn by a pair of godet rolls successively arranged at a speed of 3800 meters/minute, thereafter turned several times around said godet rolls (final one) and "Nelson" type heated roll system (surface temperature of 160° C.) located prior to the winder and finally wound up at a speed of 3830 meters/minute. The filamentary yarn is 32 deniers, 72 filaments. A satin-tricot is prepared according to a design shown in Table-IV, using the yarn of the invention as "front" yarn and polyester yarn (50 deniers, 24 filaments) on the marked as "middle" and "back" yarns.

The front side of a prepared satin tricot is raised by a wire-raising machine, as the result the raised tricot possesses a fuzzy front surface excellent in smooth touch where free ends of ameliorated thermal stability protrude straight-forwardly.

Table IV

| Bar (Reed) | Knitting design |
|---|---|
| Front | 1-0/4-5 |
| Middle | 1-2/1-0 |
| Back | 1-0/3-4 |

For comparison, on the other hand, the above example is carried out except that a polyester yarn (75 deniers, 36 filaments) on the market is used as "front" component instead of the yarn of the invention. In this case, most of free ends are crimped and a raised fabric shows harsh surface texture departing from the intended good in the present invention (Comparative example 11).

Also, the example is carried out except in that acetate yarn (75 deniers, 24 filaments) on the market is used as "front" component instead of the yarn of the invention. In this case, an appearance of free ends is fair because they are substantially free from crimp, but very poor in its function regarding compression resistance as well as thermal stability (Comparative example 12).

These results are shown in detail in Table-V.

Table V

| | Items | | Example 18 | Comparative example 11 | Comparative example 12 |
|---|---|---|---|---|---|
| Yarn | Polymer | | Polyester | Polyester | Acetate |
| | Total denier | de | 64 | 75 | 75 |
| | Number of filaments | | 144 | 36 | 20 |
| | Denier per filament | de | 0.44 | 2.1 | 3.75 |
| Yarn | fa | % | 68 | 77.2 | — |
| structure | $\epsilon_{0.2}$ | — | −0.013 | 0.030 | — |
| Physical | Tenacity per filament | g | 1.9 | 10.0 | 4.1 |
| properties | Modulus at break (Mb) | % | 5.2 | 6.5 | 2.5 |
| | Snap back (SB) | % | 4.7 | 6.1 | 3.2 |
| | State when broken | | little crook | remarkable crook | little crook |
| | B.O.S. | % | 5.9 | 9.6 | — |
| Results* | R.P. | | O | Δ | O |
| | Straightness of free ends | | O | x | Δ |
| | Hand | | O | x | Δ |

Table V-continued

| Items | Example 18 | Comparative example 11 | Comparative example 12 |
|---|---|---|---|
| Functionality | O' | O | x |

*O: Good Δ: Fair x: Poor

In Table-V, "the modulus at break (Mb)" and "Snap back (SB)" is as follows:

$$Mb=[S_b\times(100+eb)/D_o]$$

where $S_b$ is the gradient (g/%) of a tangential line contacting the break point in stress-strain curve of a sample yarn, eb is elongation (%) at break of the sample yarn and $D_o$ is a total denier of the sample yarn.

$$SB=(eb-esb)-eb\times rb$$

where eb is elongation (%) at break of a sample yarn, rb is a elongation recovery ratio (%) of the sample yarn at break point and esb is elongation (%) determined from an actual length of a sample measured just after broken.

Example 19 and Comparative example 13

Two ends (64 deniers, 144 filaments) of the yarn (32 deniers, 72 filaments) obtained in example 17 are imparted an acrylic size having a viscosity of 4.3 centi-poises by a roller sizing machine, twisted to 3000 turns/meter (S-direction and Z-direction in separate), and further imparted an acrylic size having a viscosity of 6.1 centi-poises for the purpose of temporary fixing the torque of the hard twist yarn.

A plain fabric is made from the above yarns for both the warp and the weft in end spacing of 28/cm and also in weft spacing 33/cm, where the yarns in Z twist and S-twist are placed alternately two by two. A grey fabric made is relaxed to develope a crepe in 100° C. water for 20 minutes.

For comparison, textile filamentary yarns on the market are sized, twisted and again sized in the same manner as the above. In this case, it is difficult to fix the torque to the extent that the yarns can be subjected to a weaving without the trouble by said torque and a satisfactory crepe effect is not developed in a relaxed grey fabric.

The results are shown in Table-VI.

Table VI

| | Items | | Example 19 | Comparative example 13 |
|---|---|---|---|---|
| Yarn | Total denier | de | 64 | 50 |
| | Number of filaments | — | 144 | 24 |
| | Denier per filament | de | 0.44 | 2.08 |
| Yarn structure | B.O.S. | % | 6.3 | 8.7 |
| | fa | % | 68.4 | 77 |
| | $\epsilon_{0.2}$ | — | −0.013 | −0.032 |
| Results | Shrinkage in width direction | % | 54 | 32 |
| | Crepe | | dense, minute uniform eminent surface contour | Coarse poor surface contour |

Examples 20–24 and Comparative examples 14–15

Polyethylene terephthalate containing 0.3%, by weight, of $TiO_2$ based on the polymer and having an intrinsic viscosity of 0.68 measured in ortho-chlorophenol at 35° C. is melt-spun at 303° C. through a spinneret having 72 orifices each 0.15 mm in diameter. The spun yarn is quenched to be solidified by a cooling air blowing transversely while traveling through a spinning stack, and then finishing agents is applied to the yarn by an applicator roll. The finished yarn leaving said roll is introduced into an interlace nozzle of FIGS. 1 and 2 shown in U.S. Pat. No. 2,985,995. The interlaced yarn is then withdrawn by a pair of godet rolls at a withdrawal speed of 3,800 meters/minute and fed to "Nelson" type heated rolls heated to 160° C. around which the yarn is turned to receive heat-treatment for 0.03 second at a stretch ratio of 0.3%. Finally it is wound up on a bobbin.

In the above, a draft ratio ($SD_r$) is 420. Also, air is supplied to the interlacer in various air-pressure. The results are shown in Table-VII regarding the unfolding property of the yarn when it is unwound from the bobbin (cheese) and undesirable fuzz or loop.

The unfolding property is expressed by yarn breakage frequency per an hour when the yarn is unwound from the bobbin for further processing.

Fuzz or loop is expressed in its number existing per $10^6$ meters of yarn length.

Table VII

| | Air-pressure (Kg/cm² G) | $CF_S$ | Unfolding property | Fuzz or Loop |
|---|---|---|---|---|
| Comparative example 14 | 0 | 0 | 5 | 8 |
| Example 20 | 0.3 | 5–7 | 0.1 | 2 |
| Example 21 | 0.5 | 10–12 | 0 | 0 |
| Example 22 | 1.0 | 18–20 | 0 | 0 |
| Example 23 | 2.0 | 28–30 | 0 | 0 |
| Example 24 | 3.0 | 38–40 | 0 | 1 |
| Comparative example 15 | 4.5 | 58–60 | 0 | 8 |

As is clear from the table, the yarn having $CF_S$ (Slight Coherency Factor) value of 5–40 (preferably 10–30) can be unwound continuously from the bobbin without yarn breakage and also has a diminished number with respect to the fuzz or loop.

For reference, the yarn properties are as follows:

(1) de; 0.45
(2) fa; 61(%)
(3) $\epsilon_{0.2}$; −0.016
(4) B.O.S.; 7.4(%)
(5) $X_\rho$; 34.0(%)
(6) $\rho_a$; 1.345 (grams/cm³)

We claim:

1. A linear crystalline terephthalate polyester yarn comprising a bundle of extra-fine filaments wherein that each of the individual constituents has a fineness of 0.9 denier or less and an amorphous orientation (fa) in the range of 30% to 70% and, wherein the structural integrity parameter ($\epsilon_{0.2}$) of said yarn is negative.

2. A linear crystalline terephthalate polyester yarn according to claim 1 wherein said structural integrity parameter ($\epsilon_{0.2}$) has a value expressed by the following range.

$$0>\epsilon_{0.2}\leqq-0.025$$

3. A linear crystalline terephthalate polyester yarn according to claim 1 or 2 wherein the boil-off shrinkage of said yarn is 7.5% or less.

4. A linear crystalline terephthalate polyester yarn according to claim 1 wherein said yarn has a slight coherency factor of 5 to 40 per meter when measured by the slight pin count test.

5. A polyester commingled yarn consisting essentially of:

[I] a linear crystalline terephthalate polyester yarn comprising a bundle of extra-fine filaments, wherein each of the individual constituents has a fineness of 0.9 denier or less and an amorphous orientation (fa) in the range of 30% to 70%, and wherein the structural integrity parameter ($\epsilon_{0.2}$) of said yarn is negative, and

[II] a polyester filamentary yarn, having a fineness of 1 to 3 deniers per filament, the structural integrity parameter of which is at least 0.005 lesser than that of yarn [I] and, said yarn [I] and [II] being intermingled with each other in such ratio that yarn [I] occupies 20–80% and yarn [II] 80–20% by weight based on the commingled yarn, respectively.

6. A velour-like textured yarn which is produced by a process comprising a heat-relaxation treatment followed by a raising treatment of a commingled yarn consisting essentially of [I] a linear crystalline terephthalate polyester yarn comprising a bundle of extra-fine filaments, wherein each of the individual constituents has a fineness of 0.9 denier or less and an amorphous orientation (f) in the range of 30% to 70%, and wherein the structural integrity parameter ($\epsilon_{0.2}$) is negative and [III] a multi-filamentary yarn having a boil-off shrinkage of at least 12% and still a relative boil-off shrinkage of at least 6% higher than that of yarn [I].

7. A polyester cloth having an improved resistivity to air permeation which is produced by a process comprising a pressing step of a cloth, while it is heated, for the purpose of filling interstices of said cloth, said cloth being consisting essentially of a linear crystalline terephthalate polyester yarn comprised of a bundle of extra-fine filaments, wherein each of the individual constituents has a fineness of 0.9 denier or less and an amorphous orientation (fa) in the range of 30% to 70%, and wherein the structural integrity parameter ($\epsilon_{0.2}$) of said yarn is negative.

8. A polyester cloth having a improved resistivity to air permeation according to claim 7 wherein said cloth is a woven fabric.

9. A raised cloth in which at least a face portion thereof if composed essentially of a linear crystalline terephthalate polyester yarn containing extra-fine filaments, wherein each of the filaments has a fineness of 0.9 or less and an amorphous orientation (fa) in the range of 30% to 70%, wherein the structural integrity parameter ($\epsilon_{0.2}$) of said yarn is negative, and said face portion being raised to form a fluffy portion composed of free ends of said filaments.

10. A raised cloth according to claim 9 wherein the linear crystalline polyester yarn has a tenacity of 5 grams per filament or less.

11. A hard-twist crepe fabric which is produced by a process comprising a relaxation step of a fabric to develope a crepe effect therein, said fabric containing hard-twisted yarns each of which comprises a bundle of extra-fine filaments, each filament having a fineness of 0.9 denier or less and an amorphous orientation (fa) in the range of 30% to 70%, said yarn bearing a structural integrity parameter ($\epsilon_{0.2}$) of less than zero and no less than −0.0025, and a boil-off shrinkage of no more than 7.5%.

* * * * *